US005626242A

United States Patent [19]

Weizer

[11] Patent Number: 5,626,242

[45] Date of Patent: May 6, 1997

[54] DISHRACK AND METHOD AND APPARATUS FOR MAKING SAME

[75] Inventor: Thomas C. Weizer, South Russell, Ohio

[73] Assignee: Axia Incorporated, Oak Brook, Ill.

[21] Appl. No.: 276,538

[22] Filed: Jul. 18, 1994

[51] Int. Cl.[6] ..... A47G 19/08

[52] U.S. Cl. ..... 211/41.8; 211/181.1; 211/151

[58] Field of Search ..... 211/41, 181, 151

[56] References Cited

U.S. PATENT DOCUMENTS

| | | | |
|---|---|---|---|
| 1,466,514 | 8/1923 | Smythe | 211/41 |
| 2,163,865 | 6/1939 | Bitney | 211/181 |
| 2,799,426 | 7/1957 | Kaye | 211/41 |
| 2,832,499 | 4/1958 | Maslow | 211/181 |
| 4,475,656 | 10/1984 | Collier | 211/181 |
| 5,351,837 | 10/1994 | Smith | 211/181 |

FOREIGN PATENT DOCUMENTS

| | | | |
|---|---|---|---|
| 1192605 | 10/1959 | France | 211/41 E |

OTHER PUBLICATIONS

Upper Dishrack, Drawing No. PD–3860, Aug. 15, 1988, by Nestaway Division, Axia, Inc.

*Primary Examiner*—Leslie A. Braun
*Assistant Examiner*—Willie Berry, Jr.
*Attorney, Agent, or Firm*—Laff, Whitesel, Conte & Saret, Ltd.

[57] ABSTRACT

An improved dishrack for supporting dishware includes multiple subassemblies which are attached to a frame. Each of the subassemblies includes a pair of length wires to which multiple peg wires are attached. The peg wires have peg ends which extend upwardly to help support dishware. The dishrack includes fewer intersection points and thereby traps less dirt and facilitates washing action. A more efficient method of manufacturing dishracks includes the steps of welding wires to form peg mat ladders, forming the peg mat ladders into subassemblies, and attaching the subassemblies to a frame. An apparatus for making a dishrack includes a welding jig, which forms peg ladders, and a forming die, which transforms the peg ladders into subassemblies from which the dishrack is made.

11 Claims, 4 Drawing Sheets

DISHRACK AND METHOD AND APPARATUS FOR MAKING SAME

FIELD

This invention relates to racks for supporting objects, and more particularly to dishracks which provide dishware support.

BACKGROUND

Typical dishrack structures include a rectangular frame with wires which run from front to rear and side to side. The intersection points of these wires are generally welded together to form a substantially flat, welded mesh mat. Upright, peg wires are welded to the mesh mat to provide dishware support. The mesh mat with welded upright pegs is often bent or folded so that the mesh mat includes base portions tilted at various angles from each other. These angled base portions create tilted reference planes on which the dishware may be more easily loaded. These typical current dishrack structures suffer from numerous problems and disadvantages. For example, the numerous intersecting points of the crossing wires of the mesh mat catch and collect soil which runs off from the dishware during and after washing. The intersecting points of the welded mesh mat also block the water which is spraying and flowing when the dishrack is used in a dishwasher, thereby limiting the effectiveness of the washing action of the dishwasher. This is particularly true when multiple dishracks are vertically stacked, as in most dishwashers. This limiting of the washing action inevitably and undesirably leads to dishware remaining dirty or spotted even after a dishwashing cycle.

Another disadvantage of typical dishracks grows out of the needlessly complicated and time-consuming process of manufacturing such dishracks. Numerous front-to-rear and side-to-side wires must be held in position by locating devices and then welded together, individual peg wires must be attached to the wires, ends of the peg wires must be trimmed, and the resulting structure must be folded to form the dishrack structure. This process for a typical dishrack thus requires manipulating many pieces of wire and performing several operations on each of these wires.

An additional disadvantage of this manufacturing process is the difficulty in altering dishrack structures to meet varying design requirements. The typical manufacturing process for a given dishrack configuration uses complicated and costly welding jigs to locate and weld the numerous wires to each other to form a mesh mat. Adjusting the location of the wires in this process cannot be done without significant retooling expense. In addition, an elaborate and costly forming die takes the welded mesh mat and forms it into the particular dishrack configuration desired. The dishrack configuration cannot be altered without expensive alteration to, or replacement of, the forming die.

In light of the above, there is a significant need for a dishrack structure without numerous intersecting points which inhibit washing action and accumulate soil. There is likewise a need for a dishrack which can be manufactured in a more efficient and simplified manner. A dishrack design is also needed which can be altered without entailing significant retooling costs.

SUMMARY

Accordingly, an object of this invention is to provide a new and improved dishrack structure free of numerous cross-wire joints which, when used in a dishwasher, will enhance the cleaning power of the dishwasher and eliminate the undesirable accumulation of dirt and soil on the dishrack. Further, it is an object of this invention to provide a simplified, lower cost manufacturing method for these new and improved dishracks.

Another object is to provide a dishrack structure and related manufacturing method, both of which can be easily modified without entailing significant retooling costs.

According to the present invention, the foregoing and other objects and advantages are attained by a dishrack which includes several subassemblies. Each of the subassemblies has length wires parallel to each other and peg wires with base portions attached to the length wires. The peg wires are laterally spaced from each other over the length wires. A frame surrounds the subassemblies. The length wires of the subassemblies are connected to the front and rear sides of the frame. The peg wires have peg ends which extend upwardly from the base of the peg wires to support dishware.

According to another aspect of the invention, there are three subassemblies, a central subassembly and two outer subassemblies adjacent to the central subassembly. The outer subassemblies have outer peg ends at the sides of the frame to form the sides of the dishrack. The outer subassemblies also have inner peg ends which intermesh with opposing peg ends of the central subassembly.

In accordance with still another aspect of this invention, the outer peg ends are connected to the sides of the frame.

A method of manufacturing dishracks, according to the present invention, involves welding the peg wires to the length wires to form peg mat ladders. The peg mat ladders are formed into subassemblies. The subassemblies are welded to the frame. Portions of the peg wires are trimmed to be even with the top of the frame. The assembled components are encapsulated with polyvinyl chloride ("PVC"), nylon, or other suitable material.

Still other objects, advantages, and novel aspects of the present invention will become apparent in the detailed description of the invention that follows, in which preferred embodiments of the invention are shown by way of illustration of the best mode contemplated for carrying out the invention, and by reference to the attached drawings in which.

DESCRIPTION

Figure 1:
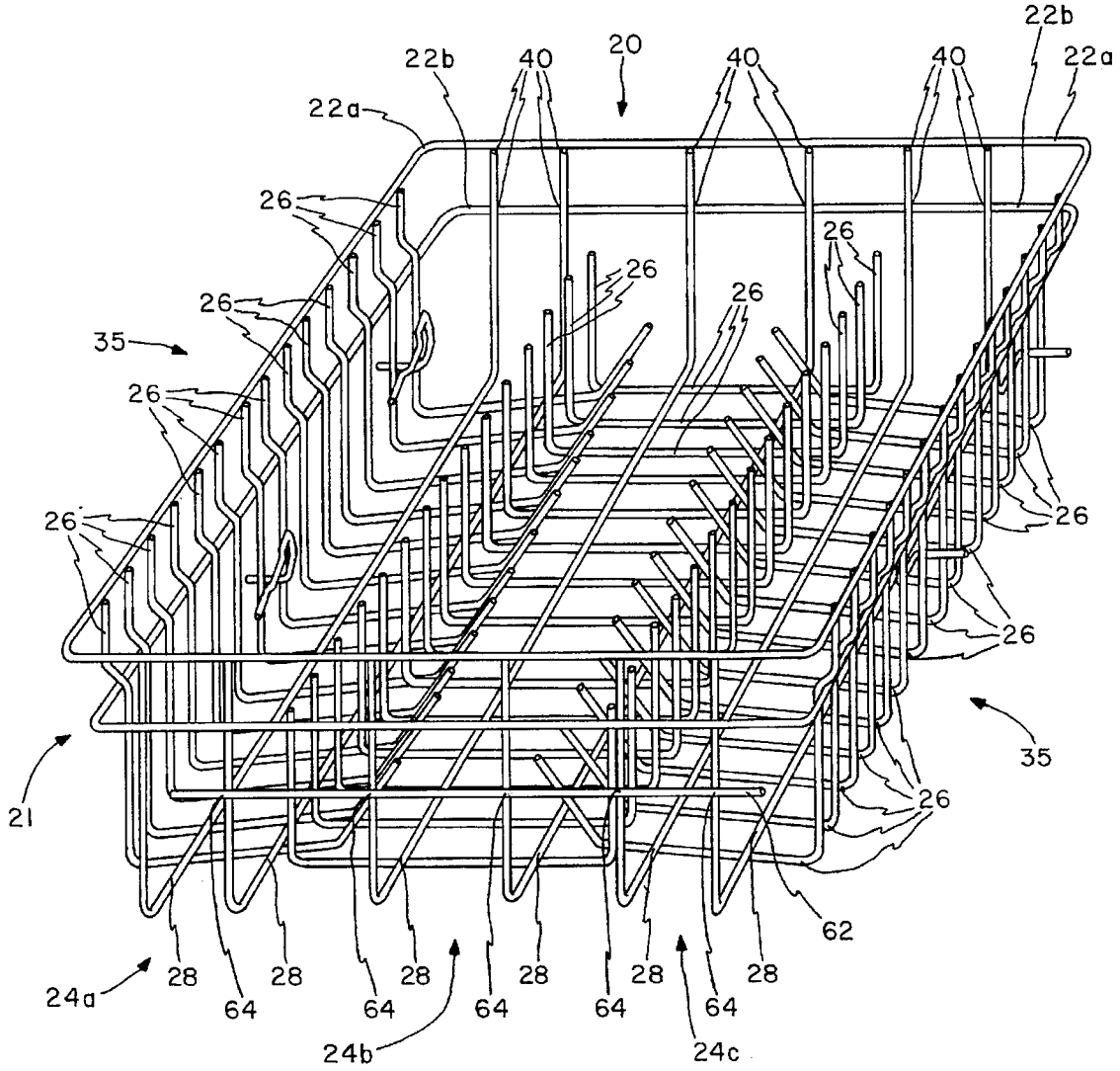
FIG. 1 is a perspective view of a dishrack incorporating the principles of the invention.
Figure 2:
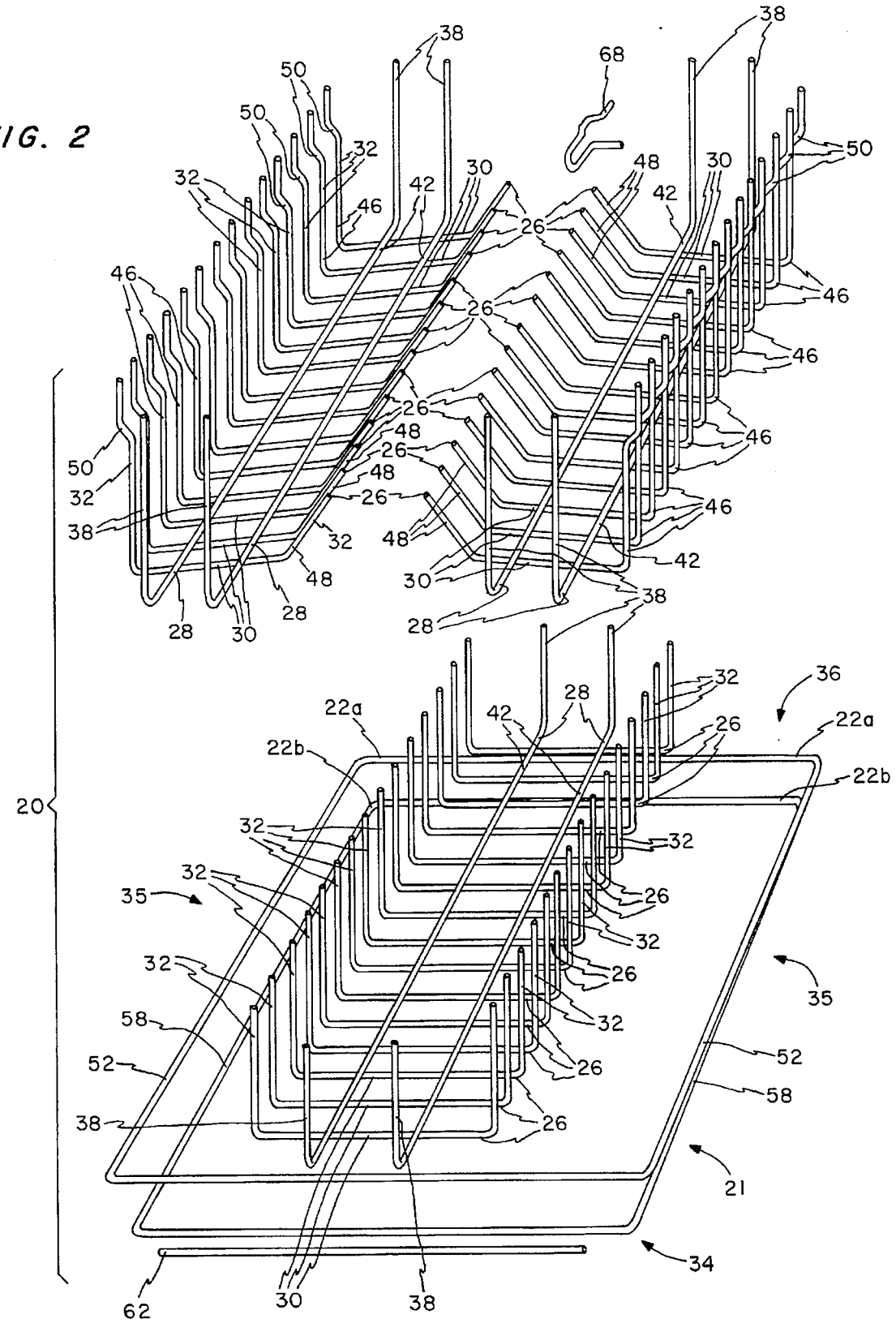
FIG. 2 is an exploded, perspective view of the dishrack of FIG. 1.

As shown in FIGS. 1 and 2, a dishrack 20 constructed in accordance with the teachings of this invention has a frame 21 comprising a pair of wire frame members 22*a* and 22*b* spaced vertically and parallel to each other, and to which are attached subassemblies 24*a–c*. Each of the subassemblies 24*a–c* includes a pair of length wires 28 and multiple peg wires 26 for supporting dishware (not shown). The length wires 28, the peg wires 26 and the wire rectangular frame members 22*a*, 22*b* are all encapsulated with PVC, nylon or other suitable material.

Figure 3:
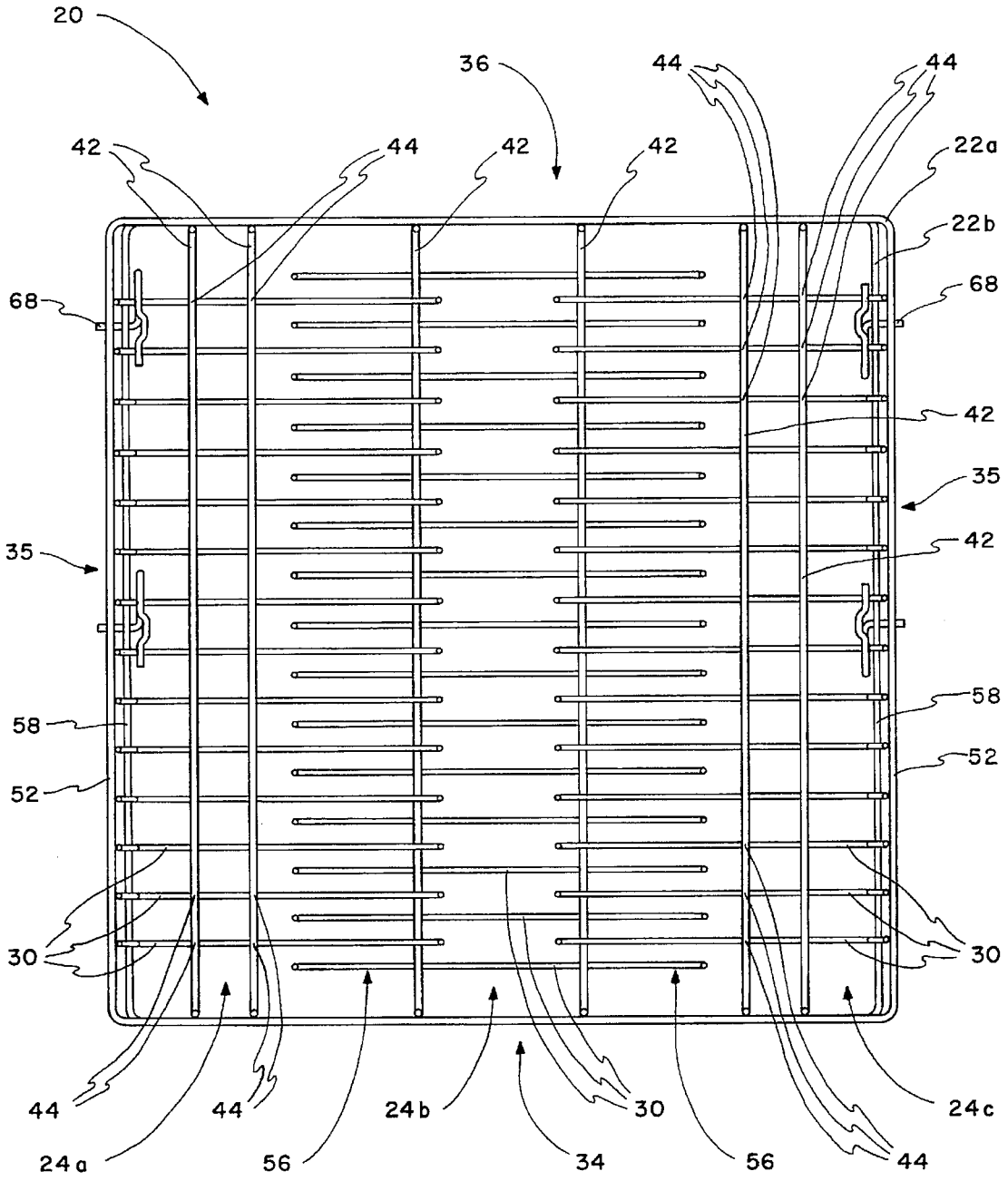
FIG. 3 is a top view of the dishrack of FIG. 1.
Figure 4:
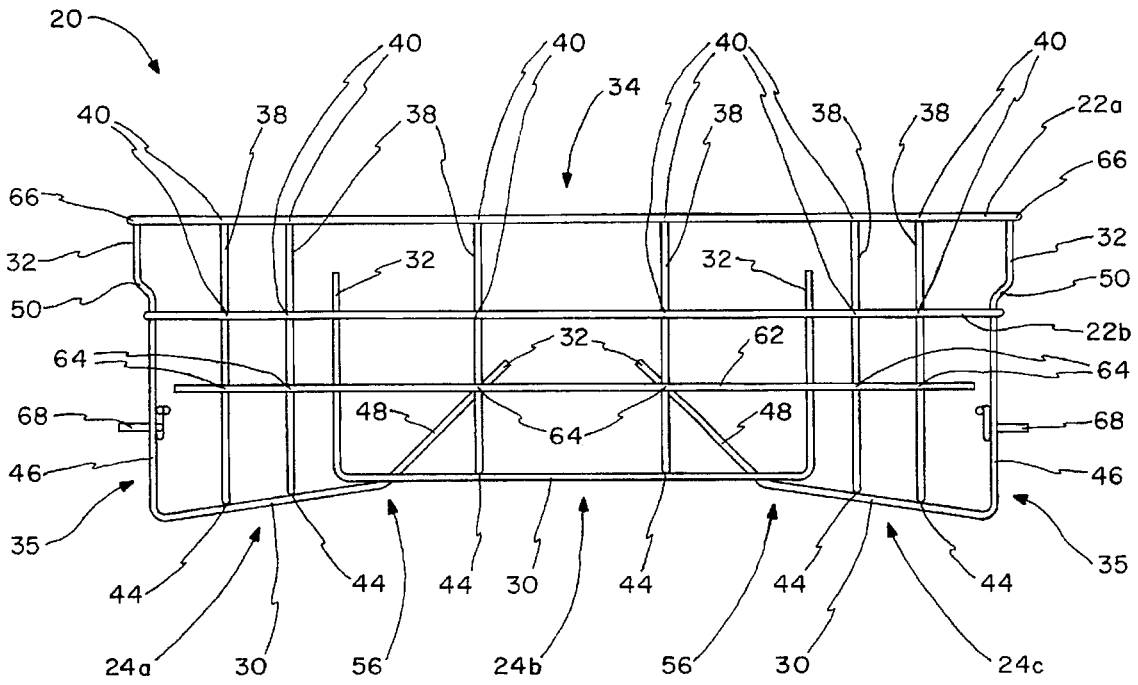
FIG. 4 is a front view of the dishrack of FIG. 1.

As shown in FIGS. 1–4, the length wires 28 of the subassemblies 24*a–c* extend generally parallel to each other and from front side 34 to rear side 36 of the dishrack 20. At the front side 24 and the rear side 36, the length wires 28 have upturned ends 38 which are attached, such as by welding, to the rectangular frame members 22*a* and 22*b* at intersection points 40 (FIGS. 1 & 4). The length wires 28 include medial portions 42 between the upturned ends 38 (FIGS. 2 & 3).

The peg wires 26 are laterally spaced along the medial portions 42 of the length wires 28 and have sufficient length so as to form intermeshing zones 56 (FIG. 3). A lateral spacing of 1.25" between adjacent peg wires 26 has been found suitable for dishracks for household dishwashers. Of course, lateral spacing and arrangement of the peg wires 26 on the length wires 28 may be varied to suit any number of dishrack designs and uses.

The subassemblies 24*a–c* of the dishrack 20 will now be described with particular reference to FIGS. 2–4. Each of the peg wires 26 has a base portion 30 which is attached, such as by welding, to the medial portions 42 of the length wires 28 at intersection points 44 (FIG. 3). Each of the peg wires 26 includes a pair of opposing peg ends 32 which extend generally upwardly from the base portions 30 of the peg wires 26. The peg wires 26 thus are generally in the shape of a U.

The peg wires 26 are arranged generally transversely to the pair of parallel length wires 28 and are spaced over the length of the medial portion 42. In this embodiment, the subassemblies 24*a* and 24*c* each have fourteen of the peg wires 26 spaced at 1.25-inch intervals along the medial portion 42. The subassembly 24*b* has fifteen of the peg wires 26 spaced at 1.25-inch intervals along the medial portion 42.

As shown particularly in FIGS. 2 and 4, the opposing ends 32 of the subassemblies 24*a* and 24*c* include outer peg ends 46 and inner peg ends 48. The outer peg ends 46 extend approximately at a right angle from the base portion 30. The outer peg ends 46 are positioned at opposing sides 35 of the dishrack 20. The inner peg ends 48 extend at an oblique angle from the base portion 30. The outer peg ends 46 include curved portions 50 which receive rectangular frame member sides 58 of the rectangular frame member 22*b*.

Figure 5:
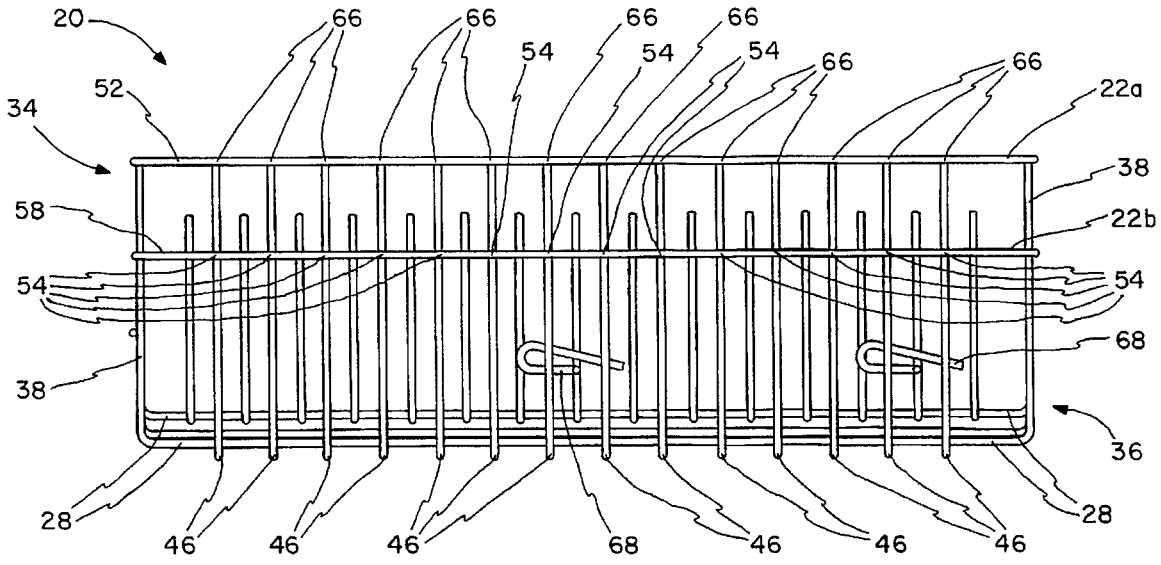
FIG. 5 is a side view of the dishrack of FIG. 1.

As shown in FIG. 5, the rectangular frame member 22*a* is connected to the subassemblies 42*a* and 24*c* by welding or otherwise permanently attaching the rectangular member 22*a* to outer peg tips 66 of the outer peg ends 46. The rectangular frame member 22*b* is attached at intersection points 54 located below the outer peg tips 66 of the outer peg ends 46.

Referring once more to FIGS. 2–4, the subassembly 24*b* has the opposing peg ends 32 extending upwardly at right angles to the bases 30 of the peg wires 26 to form a U shape. The subassemblies 24*a* and 24*c* are located adjacent to the opposing peg ends 32 of the subassemblies 24*b*. The peg wires 26 of the subassembly 24*b* are laterally offset from the peg wires 26 of the subassemblies 24*a, 24c;* and the peg wires 26 of the subassemblies 24*a–c* are of sufficient length so that the inner peg ends 48 are interposed between the opposing peg ends 32 of the subassembly 24*b*. The opposing peg ends 32 of the subassembly 24*b* thus intermesh with the inner peg ends 48 of the subassemblies 24*a* and 24*c* and thereby form the intermeshing zones 56 (FIG. 3). In light of the foregoing, the term "intermeshing" means that the peg ends oppose each other, are laterally offset from each other, and extend between each other without intersecting each other. "Intermeshing zones" are areas formed from, and created by, the intermeshing peg ends and which provide dishware support.

As shown in FIGS. 1 and 4, a straight wire 62 is welded or otherwise permanently attached at six points 64 to the upturned ends 38 of the length wires 28 at the front side 34 of the dishrack 20. The straight wire 62 generally strengthens the dishrack 20 against deformation when in use. It is particularly effective in resisting deformation if the dishrack 20 is to be repeatedly pulled out from a dishwasher by the front side 34.

Wheel mounting wires 68 are attached to the sides 35 of the dishrack 20, such as by welding. Wheels (not shown) are mounted on the mounting wires 68 to allow the dishrack 20 to be rolled by the user.

An 11-gauge wire, which is 0.120 inches in diameter, has been found suitable for the peg wires 26. Sturdier or "deluxe" dishracks may also use 10-gauge wire, which is 0.135 inches in diameter, for the peg wires 26.

An 8-gauge wire, which is 0.162 inches in diameter, has been found suitable for the length wires 28, the wires of the frame 21, and the straight wire 62. Sturdier or "deluxe" dishracks may also use 7-gauge wire, which is 0.177 inches in diameter, for the length wires 28 or the other wires of the dishrack 20. Differing wire gauges may be used for the peg wires 26 or the other wires of the dishrack 20 depending on the particular dishware to be supported, so long as the dishrack 20 and the peg wires 26 resist permanent deformation while supporting a load of dishware.

In alternate embodiments of the dishrack 20, the peg wires 26 may be of any length, gauge, and shape appropriate to the design of the dishrack 20. For example, the peg wires 26 and the opposing peg ends 32 may be longer in dishracks for holding dinner platters, pots, or other large items or shorter in dishracks for holding shot glasses, tea cups, or other more dainty dishware.

In still another alternate design, the overall height of the dishrack 20 may be reduced. In this embodiment, the straight wire 62 may be eliminated, and the frame members 22*a* and 22*b* are positioned in relation to the outer peg ends 46 so that the outer peg tips 66 extend beyond the upper rectangular member 22*a* (FIGS. 1 and 5). Thus, in this embodiment it is unnecessary to trim the outer peg ends 46 to be even with the upper rectangular member 22*a*.

Alternate embodiments may also vary the dimensions and shape of the subassemblies 24*a–c* or of the rectangular frame members 22*a, 22b* to suit particular design requirements. For example, rather than running the length wires 28 of the subassemblies 24*a–c* between the front side 34 and the rear side 26, the length wires 28 and the subassemblies may instead be sized so that they extend between the opposing frame sides 52.

While each of the subassemblies 24*a–c* has been shown in this embodiment to include a pair of length wires 28, the subassemblies 24*a–c* could alternately be constructed each with a lesser or greater number of length wires 28.

In still other alternate embodiments of the invention, the dishrack 20 may be constructed by only welding the cartridge assemblies 24*a–c* to the frame members 22*a* and 22*b* at the intersection points 40 without welding the outer peg ends 46 at the outer peg tips 66 or at the intersection points 54 (FIG. 5).

A preferred apparatus and method for manufacturing the dishracks 20 according to the present invention is now described. A pair of straight wires are located parallel to each other in a welding jig. Multiple wires are located transversely to the length wires in the welding jig and in lateral spaced relation to each other. The wires are welded or otherwise permanently attached to each other at their intersection points to form a substantially flat peg mat ladder.

The substantially flat peg mat ladder is transformed into one of the subassemblies 24*a–c* (FIGS. 1 and 2) as set out below. The peg mat ladder undergoes a forming operation, where it is bent or folded by means of a forming die. The forming die transforms the transversely welded wires into the peg wires 26 having opposing peg ends 32, and forms the upturned ends 38 of the length wires 28, thereby forming one of the subassemblies 24*a–c* into its final shape. The upturned ends 38 form a substantially right angle with the medial portions 42 of the length wires 28.

Each of the subassemblies 24*a–c* of the dishrack 20 is created by welding wires into peg ladders and forming the ladders into subassemblies as just described, with variations in the folding or bending to form the varying shapes and orientations of the opposing peg ends. The opposing peg ends 32 of the central subassembly 24*b* are bent or folded at an upward angle from the base portions 30 of approximately 90 degrees. The outer peg ends 46 are formed to include the curved portions 50 and are bent or folded at an upward angle from the base portions 30 of approximately 90 degrees. The inner peg ends 48 are bent or folded at an oblique angle from the base portions 30. No trimming operation of the peg wires is necessary in forming the subassemblies 24*a–c*.

The subassemblies 24*a–c* are welded or otherwise permanently attached to the upper and lower frame members 22*a* and 22*b* to form the dishrack front side 34, rear side 36 and opposing sides 35. The upturned ends 38 are welded to the frame members 22*a* and 22*b* at the intersection points 40. The outer peg ends 46 are welded to the frame sides 52, 58 at the outer peg tips 66 and at the intersection points 54 (FIG. 5).

The upturned ends 38 and the outer peg ends 46 are trimmed as necessary so as to be substantially even with the upper frame member 22*a*. The wheel mounting wires 68 are attached to the sides 35 of the dishrack. The assembled components, including the subassemblies 24*a–c* and the frame members 22*a–b* are encapsulated with either PVC, nylon, or other suitable material.

In addition to the advantages apparent from the above description, an advantage to the above method of fabricating the dishrack 20 using this invention is that it requires substantially fewer wire intersection points to be welded as compared to conventional dishrack manufacturing methods. In the example shown, only eighty-two wire intersection points were made, which is a 55.4% reduction in the number of mesh mat wire intersections required in a conventional design (184 intersection points). Also, only six components (not including the wheel mounting wires 68) are required to be manipulated at final assembly to form the dishrack 20: the subassemblies 24*a–c*, the frame members 22*a–b*, and the straight wire 62. This is far fewer components than are involved in final assembly under conventional methods.

The method of fabricating dishracks according to this invention has the further advantage that it eliminates the operation of trimming the peg wires 26 after they are welded to the length wires 28.

Another advantage is that there is no need to cut the peg ladders after welding to form the multiple subassemblies 24*a–c*.

As a further advantage, because the peg mat ladder is only a subcomponent, the process of locating and welding wires to form the ladder is far simpler than the conventional method of locating and welding the wires for a mesh mat of criss-crossing wires into a dishrack. As a result, the welding jigs and locating devices are smaller, less costly, and are more easily changed to accommodate variations in product design than under conventional methods.

The simplified forming operation also allows for more compact, less costly, and more easily changed forming dies. These forming dies and their related devices can be more economically retooled than under conventional methods. In other words, the manufacturing apparatus and process of the present invention is simpler, more economical, and more flexible than current apparatus or processes.

The dishrack 20, by having fewer wire intersection points, has the advantage of greatly reducing the number of catch points where soil from the dirty dishware collects, oftentimes molding, becoming unsightly, or creating an unsanitary condition. When the dishrack 20 is used in a dishwasher, the reduced number of intersection points also allows water to pass more freely through the dishrack 20 to better clean the dirty dishware in the dishrack 20.

While the present invention has been described with reference to preferred embodiments thereof, illustrated in the accompanying drawings, various changes and modifications can be made by those skilled in the art without departing from the spirit and scope of the present invention. Therefore, the appended claims are to be construed to cover equivalent structures.

What is claimed is:

1. A dishrack for use in a dishwasher comprising:

a plurality of subassemblies, each of the subassemblies having at least one length wire, and a plurality of peg wires having base portions disposed adjacent to the length wire, the base portions having opposite ends and being transverse to the length wire and laterally spaced from each other to form first intersection points between the peg wires and the length wire, the peg wires being connected to the length wire at the intersection points a frame wire having a front, a rear, and opposing sides defining a perimeter around the subassemblies, the subassemblies connected to the frame wire;

wherein the plurality of subassemblies includes a central subassembly and two outer subassemblies, the two outer subassemblies located adjacent to and on either side of the central subassembly;

wherein the peg wires of the outer subassemblies include inner and outer peg ends, the outer peg ends extending upwardly from the base portions and connected at second intersection points to the opposing sides of the frame wire to form dishrack sides, the inner peg ends extending upwardly from the base portions and within the perimeter of the frame without contacting any of the other wires of the dishrack, and wherein the peg wires of the central subassembly include opposing peg ends extending upwardly from the opposite ends of the base portions without contacting any of the other wires of the dishrack, the opposing peg ends intermeshing with the inner peg ends of the outer subassemblies;

whereby the number of wire intersections which are susceptible to catching soil from dishes in the dishwasher is limited to the first and second intersection points.

2. The dishrack of claim 1, wherein:

the length wires have upturned ends and medial portions between the upturned ends;

the base portions of the peg wires are disposed along the medial portions of the length wires; and the upturned ends of the length wires are connected to the front and rear side of the frame to form dishrack front and rear sides.

3. The dishrack of claim 1, wherein each of the subassemblies has two length wires and the peg wires are welded to the length wires at the intersection points.

4. The dishrack of claim 3, wherein the length wires are in parallel spaced relation to each other.

5. The dishrack of claim 1, wherein the frame comprises two wires formed into first and second rectangular frame members.

6. The dishrack of claim 1 comprising a straight wire connected to the length wires below the front side of the frame.

7. The dishrack of claim 1, wherein the frame and the subassemblies are encapsulated with material.

8. The dishrack of claim 7, wherein the frame and the subassemblies are encapsulated with material selected from the group consisting of PVC and nylon.

9. The dishrack of claim 1, wherein the length wires of the subassemblies are connected to the front and rear of the frame.

10. A dishwasher dishrack formed from wires and comprising:

a central subassembly and two outer subassemblies, the subassemblies having two length wires in parallel spaced relation to each other, the wires having upturned ends and medial portions between the upturned ends;

a plurality of peg wires having base portions disposed adjacent to the medial portions of the length wires, transversely to the length wires, and laterally spaced from adjacent base portions to form first dishware support areas with intersection points between the peg wires and the length wires, the peg wires being welded to the length wires at the intersection points;

a frame having two wires formed into first and second rectangular frame members, the frame adapted to receive the subassemblies within its perimeter, the frame having opposing sides extending parallel to each other and parallel to the length wires, the frame having a front and a rear extending parallel to each other and transversely to the length wires;

the upturned ends of the length wires of the subassemblies being connected to the front and rear sides of the frame to form dishrack front and rear side portions;

the peg wires of the outer subassemblies including inner peg ends and outer peg ends, the outer peg ends extending upwardly from the base portion, the outer peg ends connected to the opposing sides of the frame to form dishrack side portions, the inner peg ends extending upwardly from the base portions within the perimeter of the frame and without contacting any of the other wires of the dishrack;

the peg wires of the central subassembly including opposing peg ends extending upwardly from the base portions of the peg wires of the central subassembly without contacting any of the other wires of the dishrack;

the outer peg ends having tips connected to the opposing sides of the first rectangular member, the second rectangular member connected to the outer peg ends and in spaced relation to the first rectangular member;

the peg wires of the outer subassemblies located in laterally offset relation to the peg wires of the central subassembly the inner peg ends and the opposing peg ends of the central subassembly oriented to form intermeshing zones and second dishware support areas, wherein the adjacent peg wires of the second dishware support areas are more closely spaced than in the first dishware support areas;

a straight wire extending along the dishrack front side portion and connected to the upturned ends of the length wires at points below the front side of the second frame; and the frame and the subassemblies being encapsulated in a compound selected from the group consisting of PVC and nylon.

11. A dishwasher dishrack formed from wires and comprising:

(a) a plurality of subassemblies having sides, the subassemblies disposed side-by-side so that the adjacent sides of the adjacent subassemblies oppose each other, each of the subassemblies having length wires in spaced relation to each other;

(b) a plurality of peg wires having base portions disposed adjacent to the length wires, the base portions being transverse to the length wires and laterally spaced from each other to form intersection points between the peg wires and the length wires, the peg wires being connected to the length wires at the intersection points, the peg wires including opposing peg ends inclined upwardly from the base portions and in the direction of the sides of the subassemblies; and (c) a frame having a front, a rear, and opposing sides defining a perimeter around the subassemblies, the subassemblies connected to the frame, wherein peg ends of the adjacent subassemblies intermesh with each other and do not intersect any of the wires of the dishrack, thereby avoiding additional wire intersections susceptible to catching soil from dishes in the dishwasher.

* * * * *